US005081491A

United States Patent [19]

Lux et al.

[11] Patent Number: 5,081,491

[45] Date of Patent: Jan. 14, 1992

[54] TONER MAINTENANCE SUBSYSTEM FOR A PRINTING MACHINE

[75] Inventors: Richard A. Lux, Webster; John C. Prusinowski, Fairport, both of N.Y.

[73] Assignee: Xerox Corporation, Stamford, Conn.

[21] Appl. No.: 622,043

[22] Filed: Dec. 4, 1990

[51] Int. Cl.[5] ..... G03G 15/08

[52] U.S. Cl. ..... 355/208; 355/246

[58] Field of Search ..... 355/208, 246; 118/688-691, 665; 222/DIG. 1

[56] References Cited

U.S. PATENT DOCUMENTS

| | | | |
|---|---|---|---|
| 3,873,002 | 3/1975 | Davidson et al. | 222/56 |
| 4,318,610 | 3/1982 | Grace | 355/246 |
| 4,326,646 | 4/1982 | Lavery et al. | 222/56 |
| 4,348,099 | 9/1982 | Fantozzi | 355/208 |
| 4,607,944 | 8/1986 | Rushing | 355/246 |
| 4,875,078 | 10/1989 | Resch, III et al. | 355/246 |
| 4,956,669 | 9/1990 | Nakamura | 355/208 |

*Primary Examiner*—Joan H. Pendegrass

*Attorney, Agent, or Firm*—Duane C. Basch; Henry Fleischer

[57] ABSTRACT

An apparatus for controlling the concentration of toner within a developer material of carrier and toner. The apparatus having a control means for generating a toner addition signal indicative of the amount of toner to be added to the developer material. The control means including the ability to measure the concentration of toner within the developer material during at least a first period and a second period subsequent to the first period. The control means also determining a first concentration error as a function of the deviation between the toner concentration measured during the first period and a reference toner concentration and a second concentration error as a function of the deviation between the toner concentration measured during the second period and the reference toner concentration. Subsequently, the control means generates the toner addition signal as a function of the first and second concentration error values. The apparatus also includes means, responsive to the toner addition signal, for regulating the addition of toner to said developer material.

23 Claims, 5 Drawing Sheets

TONER MAINTENANCE SUBSYSTEM FOR A PRINTING MACHINE

This invention relates generally to a printing machine, and more particularly concerns an apparatus for controlling the concentration of toner in the development system of an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. Subsequently, the toner particles are heated to permanently affix the powder image to the copy sheet.

In a machine of the foregoing type, it is desirable to regulate the addition of toner particles to the developer material in order to ultimately control the triboelectric characteristics (tribo) of the developer material. However, control of the triboelectric characteristics of the developer material are generally considered to be a function of the toner concentration within the material. Therefore, for practical purposes, machines of the foreoing type usually attempt to control the concentration of toner in the developer material.

Various approaches have been devised for controlling the concentration of toner in the development system. The following disclosures appear to be relevant:

U.S. Pat. No. 3,873,002
Patentee: Davidson et al.
Issued: Mar. 25, 1975.

U.S. Pat. No. 4,318,610
Patentee: Grace.
Issued: Mar. 9, 1982.

U.S. Pat. No. 4,326,646
Patentee: Lavery et al.
Issued: Apr. 27, 1982.

U.S. Pat. No. 4,348,099
Patentee: Fantozzi.
Issued: Sept. 7, 1982.

U.S. Pat. No. 4,956,669
Patentee: Nakamura et al.
Issued: Sept. 11, 1990.

The relevant portions of the foregoing patents may be summarized as follows:

Davidson et al. describes a control device which regulates the dispensing of predetermined quantities of particles from a storage container to a mix for maintaining the concentration thereof substantially at a preselected level. Specifically, a detecting means is used to determine the toner concentration and to signal a count detector. Subsequently, control logic analyzes the value contained in the count detector to determine whether a half or full toner dispense cycle is required.

Grace describes an apparatus in which toner particle concentration within a developer mixture and charging of the photoconductive surface are controlled. More specifically, an infrared densitometer generates electrical signals proportional to the developed toner mass of test areas on the photoconductive surface. The signals are fed through a conversion circuit and subsequently interpreted by a controller. The controller energizes a toner dispense motor, via a logic interface, whenever the detected density of the toner concentration test patch is below a nominal level. In addition, successive energizing of the toner dispense motor without an increase in detected density results in the generation of a "toner container empty" signal by the controller.

Lavery et al. discloses an automatic development control system utilizing a control loop to vary the time period of activation of a toner dispenser. The toner dispenser is activated for a predetermined fraction of the copy cycle depending upon the relative density of a test patch versus a desired density. For example, when the detected test patch toner density is first indicated as low, the toner dispenser is activated for a period of 0.5 seconds. For successive indications of a low toner density the toner dispenser is activated in increments of 0.5 seconds up to a maximum period of 1.5 seconds.

Fantozzi teaches a sample data control system for controlling charge, illumination, toner dispensing, and developer bias. The system disclosed utilizes a toner dispensing control loop for regulating toner, wherein the control loop responds to a signal from an infrared sensor which detects the density of a developed test patch. Specifically, the voltage level from the sensor is compared against a reference voltage. If the voltage from the sensor is indicative of a toner density less than the desired density, the dispense motor is activated at a low or high rate. Once the toner density is determined to be sufficiently greater than the desired density, the dispense motor is turned off. This control process continues with the dispense motor being activated as required and the adjustment or activation of the toner dispenser being made if required preferably after each even copy cycle.

Finally, Nakamura et al. describes a control apparatus for controlling the concentration of toner incorporated in developing material by means of controlling toner replenishment. Specifically, a toner concentration detecting sensor signal is analyzed to detect an abnormal sensor condition. When such a situation occurs, toner is dispensed at a constant volume. If the sensor is operating normally, an average signal level is used to determine the toner volume to be dispensed.

In accordance with one aspect of the present invention, there is provided an apparatus for controlling the concentration of toner within a developer material of carrier and toner having a control means for generating a toner addition signal indicative of the amount of toner to be added to the developer material. The control means including the ability to measure the concentration of toner within the developer material during at least a first period and a second period subsequent to the first period. The control means also determining a first concentration error value as a function of the deviation between the toner concentration measured during the first period and a first reference toner concentration and a second concentration error value as a function of the deviation between the toner concentration measured during the second period and a second reference toner concentration. Subsequently, the control means generates the toner addition signal as a function of the first and second concentration error values. The apparatus also includes means, responsive to the toner addition signal, for regulating the addition of toner to said developer material.

Pursuant to another aspect of the features of the present invention, there is provided an electrophotographic printing machine having a development subsystem arranged to supply a developer mixture, with a controlled toner concentration, for the development of a latent electrostatic image, and means for periodically measuring the toner concentration within the developer mixture. The machine also includes means, operative at a first time, for calculating a first error value which is indicative of the deviation of the measured toner concentration from a first desired toner concentration, and means, operative at a second time subsequent to the first time, for calculating a second error value which is indicative of the deviation of the measured toner concentration from a second desired toner concentration. In addition, means for determining the amount of toner that was added to the development mixture are operative between the first and second times to determine the amount of toner added to the developer mixture. Moreover, the machine includes means for generating a toner dispense level in response to the first error value, the second error value and the amount of toner added, and regulating means to regulate the addition of toner to the development mixture in response to the toner dispense level.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
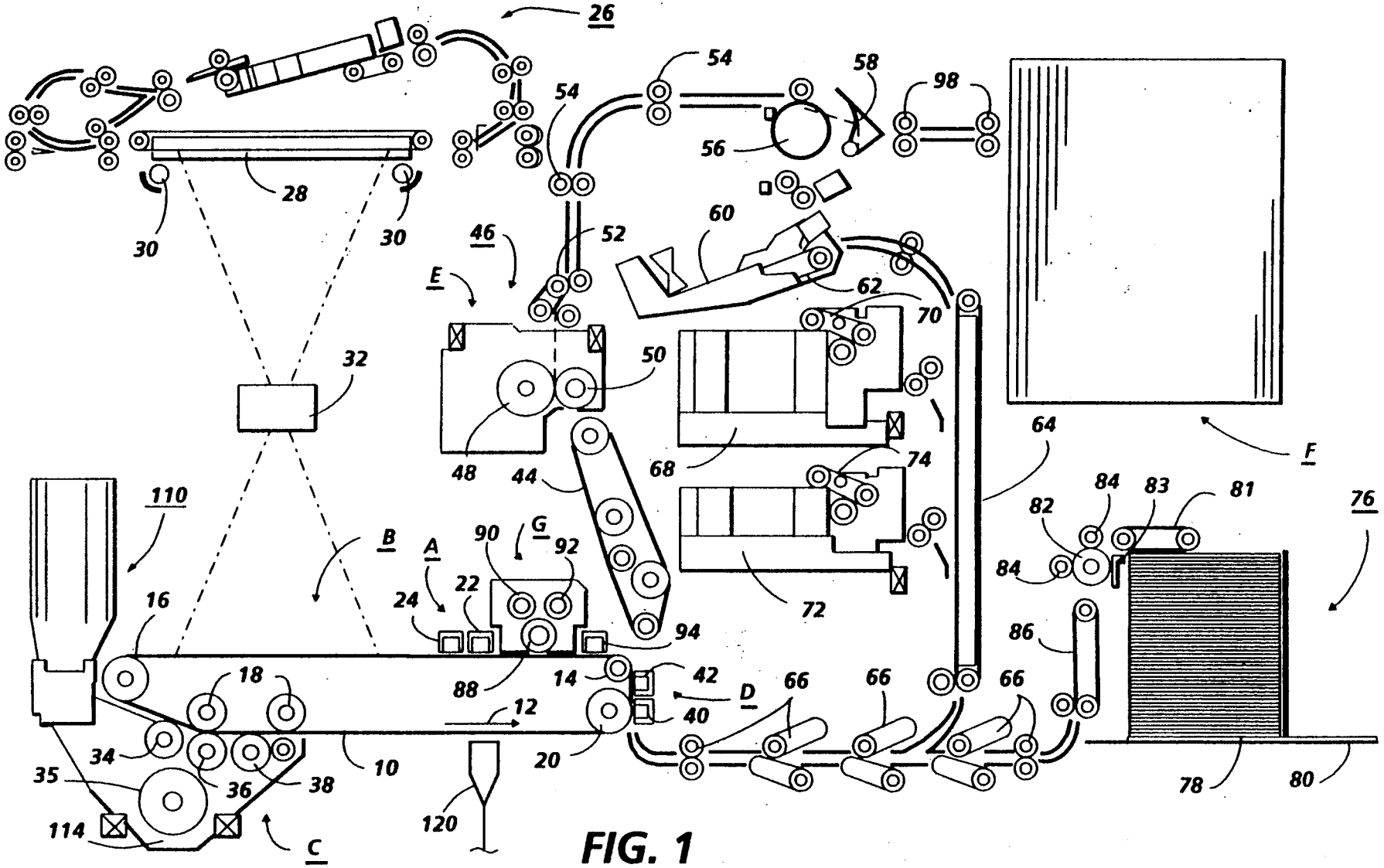
FIG. 1 is a schematic elevational view depicting an illustrative electrophotographic printing machine having a developer incorporating the apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24, charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference numeral 26, is positioned over platen 28 of the printing machine. Document handling unit 26 sequentially feeds original documents from a stack of documents placed by the operator face up in a normal forward collated order in the document stacking and holding tray. A document feeder located below the tray forwards the bottom document in the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the top of the stack of original documents through the feed roll pair. A position gate is provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document. In this way, a plurality of original documents may be sequentially exposed. Alternatively, document handling unit 26 may be pivoted away from platen 28 and an original document positioned manually thereon. One or more copies of the original document may be reproduced by the printing machine. The original document is exposed and a latent image recorded on the photoconductive belt. Thereafter, belt 10 advances the electrostatic latent image recorded thereon to development station C.

Development station C has three magnetic brush developer rolls, indicated generally by the reference numerals 34, 36 and 38. Paddle wheel 35 picks up developer material from developer sump 114 and delivers it to the developer rolls. When developer material reaches rolls 34 and 36, it is magnetically split between the rolls with half the developer material being delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a developed toner powder image on the photoconductive surface of belt 10. Belt 10 then advances the developed toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove the curl.

Forwarding rollers 54 then advance the sheet to duplex turn roll 56. Duplex solenoid gate 58 guides the sheet to the finishing station F or to duplex tray 60. At finishing station F, copy sheets are stacked in compiler trays to form sets of copy sheets. The sheets of each set are optionally stapled to one another. The sets of copy sheets are then delivered to a stacking tray. In the stacking tray, each set of copy sheets may be offset from an adjacent set of copy sheets. Further details of finishing station F will be described hereinafter with reference to FIG. 2.

With continued reference to FIG. 1, when duplex solenoid gate 58 diverts the sheet into duplex tray 60. Duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. A high capacity feeder, indicated generally by the reference numeral 76, is the primary source of copy sheets. High capacity feeder 76 includes a tray 78 supported on an elevator 80. The elevator is driven by a bidirectional AC motor to move the tray up or down. In the up position, the copy sheets are advanced from the tray to transfer station D. A fluffer and air knife 83 direct air onto the stack of copy sheets on tray 78 to separate the uppermost sheet from the stack of copy sheets. A vacuum pulls the uppermost sheet against feed belt 81. Feed belt 81 feeds successive uppermost sheets from the stack to an take-away drive roll 82 and idler rolls 84. The drive roll and idler rolls guide the sheet onto transport 86. Transport 86 advances the sheet to rolls 66 which, in turn, move the sheet to transfer station station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
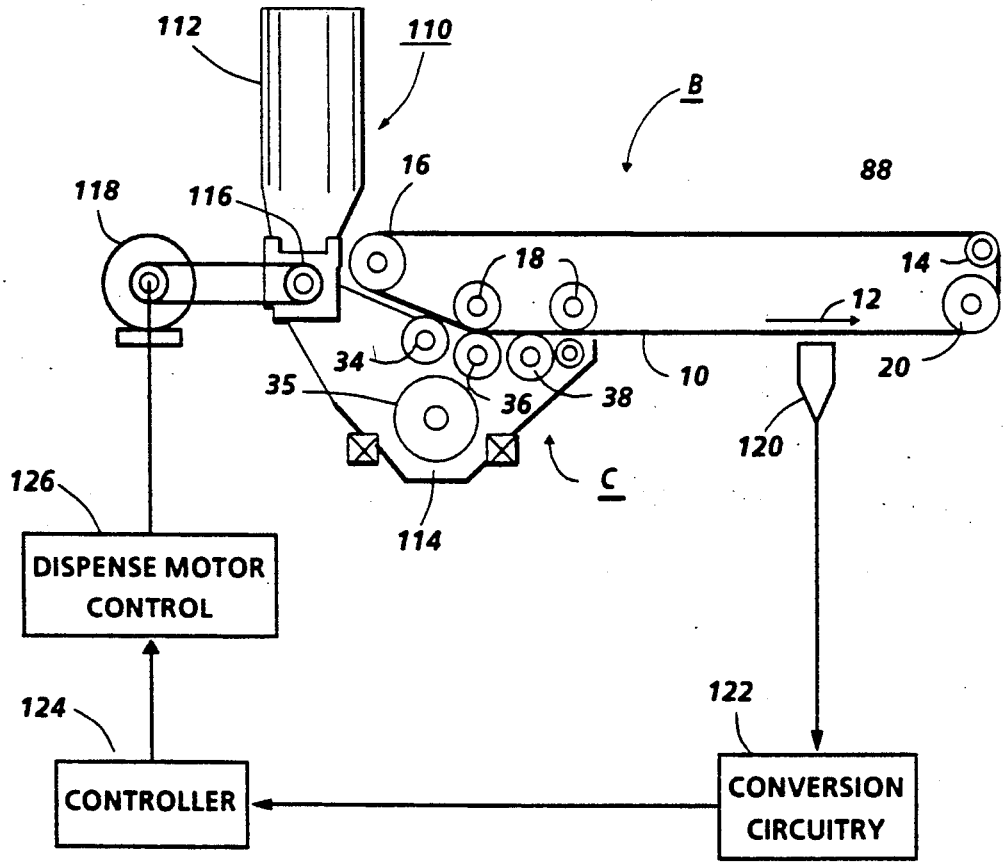
FIG. 2 is an block diagram showing the electromechanical components of the present invention.

Referring now to FIG. 2, the general operation of the toner maintenance subsystem within development station C will now be described. Exposure station B includes a test area generator (not shown) to discharge a portion of belt 10 to produce a latent test area. Generally, the discharged or latent test area will occupy an inter-document zone so as to avoid any deleterious effects to latent images exposed from the platen. After discharging the test area, belt 10 is advanced to development station C where the toner is deposited upon the latent test area. The amount or mass of toner deposited upon the test area is indicative of the toner concentration within the developer material at the time the area is developed. Specifically, the toner maintenance subsystem is designed to improve copy quality by controlling the amount or mass of toner developed on the copy sheet, for a given document area coverage, by regulating the concentration of toner within the developer material.

Subsequent to development of the test area, belt 10 is advanced thereby causing the developed test area to pass infrared lamp/detector module 120. More specifically, an infrared (I/R) lamp within module 120 directs a light beam onto the developed test area of belt 10. Concurrently, an I/R detector within module 120 detects the intensity of the reflected beam. The intensity is a measure of the reflectivity of the developed test area. Module 120 sends a signal representative of the intensity to conversion circuitry 122 which in turn integrates and converts the signal to provide a measurement of the developed toner mass residing on the developed test area. The detected toner mass is referred to as ird in FIG. 3.

Development station C receives toner from a toner dispenser indicated generally by reference numeral 110. The supply of toner is maintained in container 112 and is introduced to development sump 114 via mixing auger 116 which is driven at a constant rate whenever AC motor 118 is energized. Energizing AC motor 118 not only drives auger 116 but also drives a metering roll (not shown) that regulates the flow of toner into the auger. For example, auger 116 may comprise a helical spring mounted in a tube, whereby rotation of the spring causes toner to advance through the tube and to be mixed with developer material recycled from the the developer sump 114. The energizing of motor 118 is directly controlled by dispense motor control 126 which in turn is signaled by the toner dispense control loop of the present invention. Introduction of the toner in this way would assure that uncharged toner is never introduced directly into the development station C.

Figure 3:
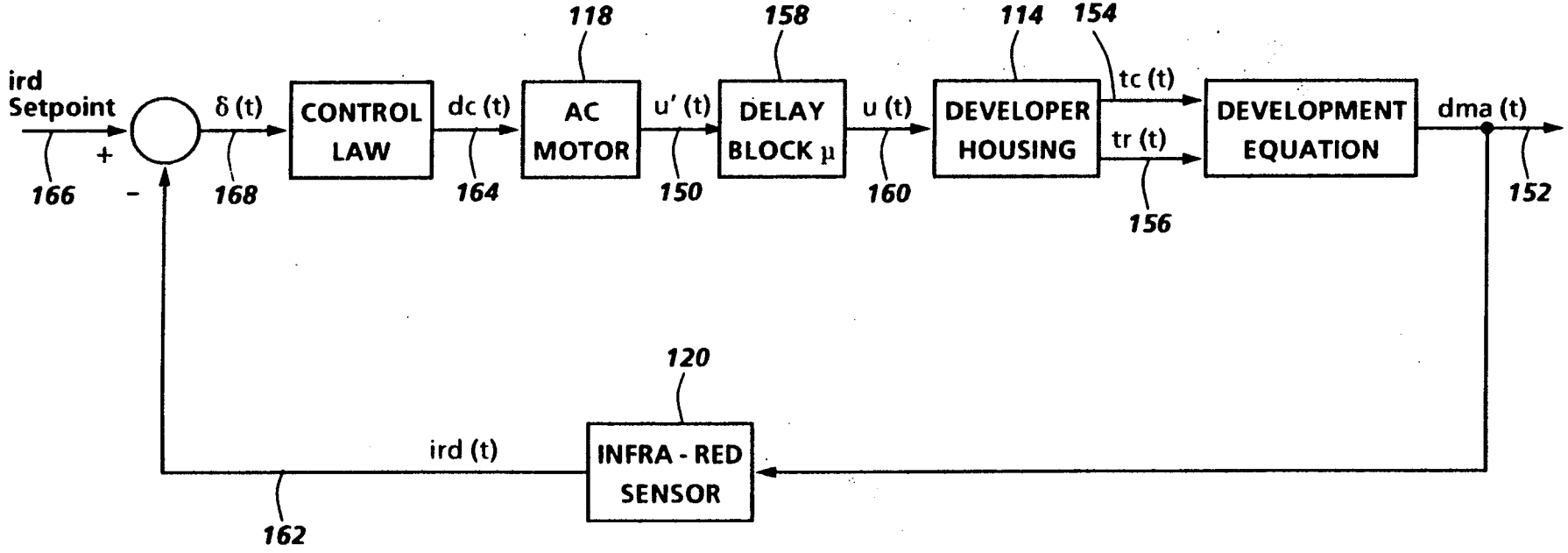
FIG. 3 illustrates a block diagram of the feedback control system of the present invention.

To enable a better understanding of the toner maintenance system, a mathematical model was derived to represent the feedback control system illustrated in FIG. 3. The five part model specifically relates the toner triboelectric charge or tribo (tr(t)) and toner concentration in the developer material (tc(t)) using an ordinary differential equation. Referring now to FIG. 3, the toner concentration is modeled by the following equation:

$$\frac{d}{dt}\, tc(t) = 100\,\frac{u(t) - v(t)}{M_c} \tag{1}$$

where u(t) is the rate at which toner is added to developer material in developer sump 114, control signal 150, v(t) is the rate at which toner is removed from the developer material due to developement of latent electrostatic images, and $M_c$ is the mass of the carrier in the developer material. In general, the developer material acts as an integrator for the net toner input flow.

Second, the amount of toner developed on the photoconductive belt is a function of the tribo, the toner concentration and the voltage on belt 10. A simplified model of the tribo, defined hereinafter as the ratio of the total charge on a batch of toner particles to the total mass of the particles, is represented by a first order differential equation as follows:

$$\frac{d}{dt}\, tr(t) = \frac{1}{\beta}\,(tr_{\infty} - tr(t)) - \frac{u(t)}{M_T(t)}\,(tr(t) - tr_i) \tag{2}$$

where $\beta$ is the charging rate of the toner particles, $tr_{\infty}$ is a constant representing the maximum attainable tribo charge, $M_T$ is the mass of the toner within the developer material, and $tr_i$ is the initial charge of the toner after dispense from container 112 of FIG. 2.

Next, the toner development model was established with the following empirical relationship:

$$dma(t) = a + V_{dev}(t)\left[\, b + c\,tc(t) + \frac{d}{tr(t)} \,\right] \tag{3}$$

where dma(t) represents the developed mass of toner, signal 152, $V_{dev}$ the bias development voltage, tr(t) the tribo of the toner in the developer material, signal 154, and tc(t) the toner concentration in the developer material, signal 156. Furthermore, parameters a, b, and c are system dependent constants.

Fourth, the toner dispenser, consisting of the aforementioned mixing auger 116 and AC motor 118, was studied to characterize the time required for a toner particle to travel the length of the auger tube. There is an inherent lag time between the actual addition of the toner particle to the auger and the time when the particle exits the auger having been mixed with the recycled developer material. This transportation lag is modeled by:

$$u(t)=u'(t-\mu) \quad (4)$$

where $\mu$ is a constant delay, block 158, representative of a lag time of about 25 seconds, u'(t) is the rate at which the motor dispenses toner, signal 150, and u(t) is, again, the rate at which toner is available in the developer housing (i.e. when it reaches the end of auger 116), shown as signal 160. Generally, the dispense control strategy is to toggle AC motor 118 "on" and "off" each sampling period. Furthermore, if T is the sampling period, dc(k) the duty cycle of AC motor 118 in the $k^{th}$ sampling period, and $u_{max}$ the rate at which toner is dispensed to auger 116 when AC motor 118 is "on", then the amount of toner dispensed in the $k^{th}$ sampling period is equal to $Tdc(k)u_{max}$.

Finally, the infrared sensor, module 120, which converts reflectance to a digital representation (ird(t)) can be used to approximate the developed mass of toner on the test area. A typical relationship between module 120 output, ird(t) as shown by signal 162, and the developed mass, dma(t) or signal 152, is expressed in a linear fashion as follows:

$$ird(t)=m_1 dma(t)+m_2 \quad (5)$$

where $m_1$ and $m_2$ are constants. It is important to note that the reflectance of the developed test area is measured after the test area has passed development station C, thereby introducing a time lag into the control loop. Such a delay could be incorporated into the ird measurement, however, due to the delay incorporated in the toner dispense model (Equation 4) and the speed of belt 10, no delay was factored into the sensor equation. It was further determined that a dma setpoint of 0.52 mg/cm$^2$ corresponds to an ird setpoint, illustrated as input signal 166, of about 85 ird bits. While the dma setpoint indicated is typical of the present embodiment, the value is variable depending upon the mechanical configuration of the machine, as well as, the type of toner used in the developer material.

The toner maintenance subsystem is controlled by the linear feedback control system illustrated in FIG. 3. After modeling the individual components of the toner maintenance system, it was necessary to design a control law to reduce the steady state error in developed mass that occurs through toner removal as a result of latent image development. Initially, the nonlinear state and output equations, Equations 1, 2, and 3, were linearized. Subsequently, the linearized model equations were discretized under the assumption that toner dispensing is accomplished in a pulse-width modulated fashion. Pulse-width modulation (PWM) of the control signal is an alternative to amplitude modulation and arises since the actuator is an AC motor which is either "on" or "off". Due to PWM, the resulting differential equations were once again nonlinear and another linearization step was required. Finally, a discrete time feedback system was synthesized to achieve zero steady state error regulation, including the selection of a discrete time proportional-integral (PI) compensator to meet the requirements. The resulting control law, expressed as a difference equation, is as follows:

$$\delta(k)=\alpha_1 e(k)-\alpha_2 e(k-1)+\delta(k-1) \quad (6)$$

where $\alpha_1$ and $\alpha_2$ are constants and $\delta(k)$ represents the present difference, signal 168, $\delta(k-1)$ represents the previous difference. Error e(k), where e(k)=dma(k)-0.52, reflects the deviation between the actual developed mass and the desired developed toner mass of 0.52 mg/cm$^2$. In addition, the previous error term e(k−1) is representative of the previous deviation between the previously measured toner mass dma(k−1) and the desired mass of 0.52 mg/cm$^2$. Practically speaking, the error terms e(k) and e(k−1) were determined by calculating the deviation between the incoming ird signal and the ird setpoint of 85 as previously mentioned. Alternatively, the desired toner mass may be a variable value that is changed in accordance with a specific document type or in response to other system factors. Furthermore, the duty cycle of AC motor 118, dc(k) and signal 164, is related to $\delta(k)$ by the normalized equation:

$$dc(k)=\delta(k)+0.5 \quad (7)$$

The control law is also constrained by the limits $dc(k)\epsilon[0.2\ 0.8]$ in a preferred embodiment, where the lower limit is established by quantifying the amount of time required to overcome the inertia within the development subsystem. The upper limit is based upon the portion of the duty cycle required to obtain a predetermined maximum amount of toner dispense. The upper limit is a function of the rate at which AC motor 118 is driven, thereby requiring a limit of 0.8 when the motor is driven by 60 Hz AC power and a limit of 1.0 when the motor is driven by 50 Hz AC power. Furthermore, the control limits may be set in memory which is coupled to controller 124, preferably non-volatile memory (NVM). The control law and the associated constraints are implemented as follows:

| | |
|---|---|
| if $\delta(k) + 0.5 \leqq 0.1$ | **Excess - No Duty Cycle** |
| then dc(k) = 0; | |
| elseif $\delta(k) + 0.5 \leqq 0.2$ | **Low Duty Cycle** |
| then dc(k) = 0.2; | |
| elseif $\delta(k) + 0.5 \leqq 0.8$ | **Normal Duty Cycle** |
| then dc(k) = $\delta(k) + 0.5$; | |
| elseif $\delta(k) + 0.5 > 0.8$ | **High Duty Cycle** |
| then dc(k) = 0.8; | |

In the implementation of the above control law, certain modifications were made to make the implementation more efficient from a software and arithmetic processing standpoint. Specifically, the control law was restated as follows:

$$CD(n)=CD(n-1)+\alpha_1 E(n-)-\alpha_2 E(n-1)-MD(n-1) \quad (8)$$

where CD(n) represents the toner dispense level currently required $\delta(n)$, CD(n−1) represents the previous toner dispense level $\delta(n-1)$, E(n) the current error term e(n), and E(n−1) the previous error term e(n−1). The MD(n−1) term is introduced to track negative values for $\delta(n)$ in order to eliminate the need for sign checking of the control variables. For example, when $\delta(n)$ is a positive value, CD(n) is equal to $\delta(n)$ and MD(n) is reset to zero. Moreover, when $\delta(n)$ is negative, MD(n) is set equal to $-\delta(n)$ and CD(n) is reset to zero. In this manner, the sign of the resultant difference is tracked via two separate variables.

Figure 4:
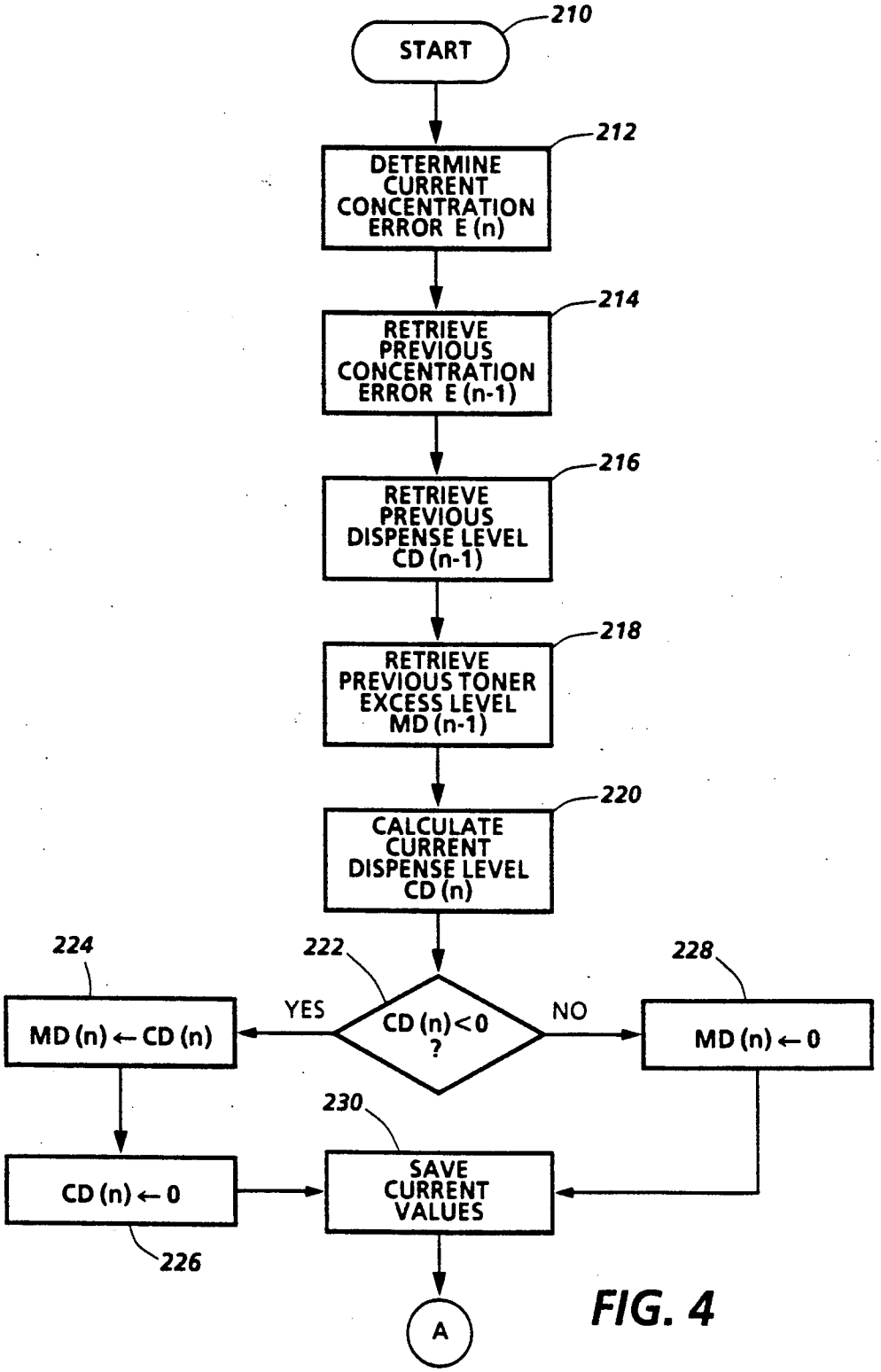
FIGS. 4A and 4B represent a flowchart depicting the control steps associated with the present invention.
Figure 5:
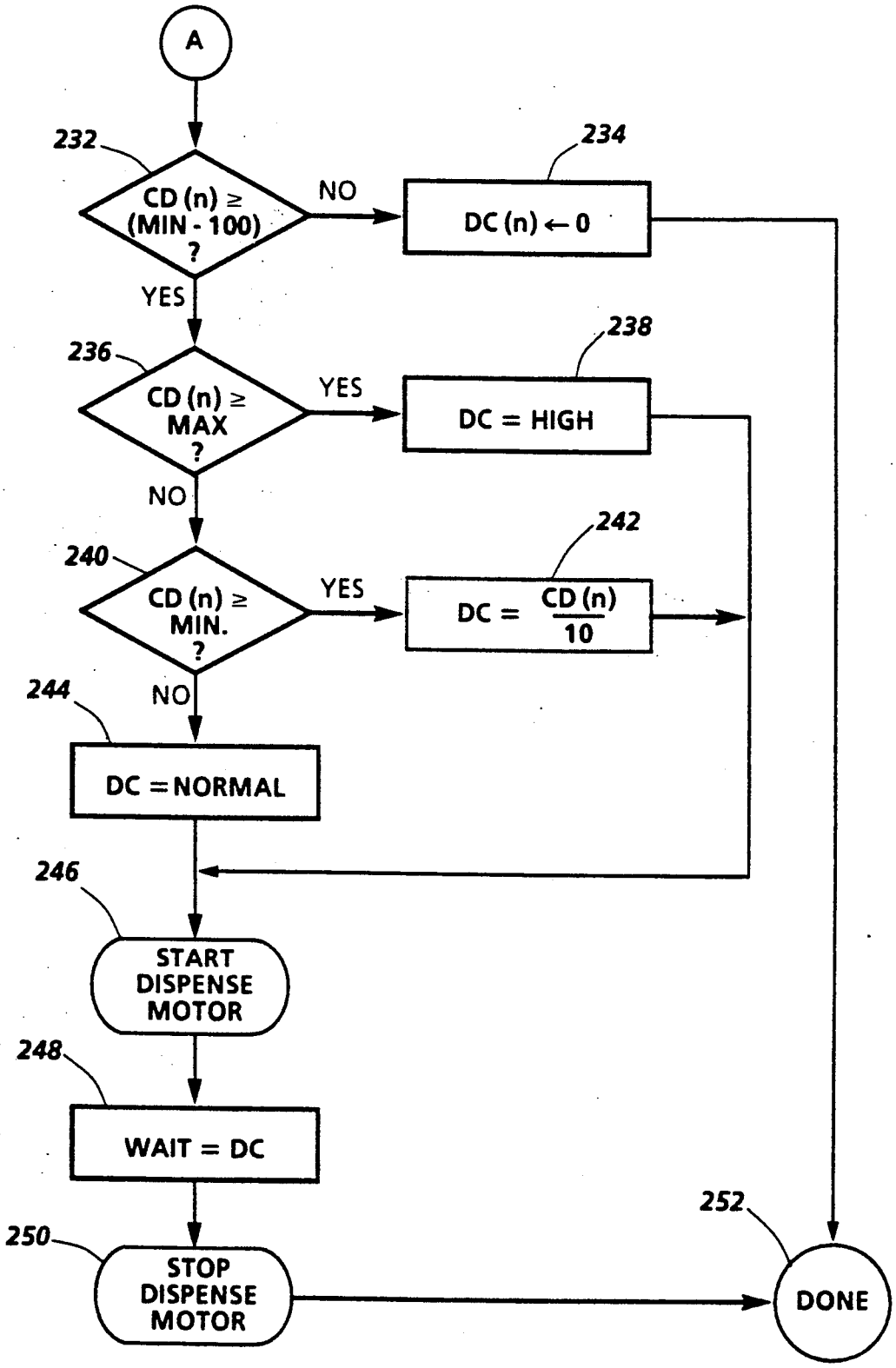

Referring now to FIGS. 4A and 4B, the toner concentration control process begins at step 210. The control process implemented in the preferred embodiment hereafter described is based upon Equation 8 above, which includes the minor modifications indicated to enable the process to be controlled by a microcontroller or microprocessor (e.g., an Intel ® 8085). At step 212, controller 124 of FIG. 2 determines the current toner concentration error term E(n) by calculating the difference between the ird signal from the infrared detector, via conversion circuit 122 of FIG. 2, and the ird setpoint. Next, in step 214 the previous toner concentration error term E(n−1) is retrieved from memory having been calculated and stored during a previous control period. Steps 216 and 218 retrieve the previous dispense (CD(n−1)) and excess (MD(n−1)) values from memory, the values having been generated during the preceding control period. Subsequently, step 220 calculates current toner dispense level CD(n) in accordance with Equation 8, substituting the appropriate constants or weighting factors, $\alpha_1$ and $\alpha_2$.

Having calculated current dispense level CD(n) in step 220, the controller then tests the sign of CD(n) at step 222. If the sign of CD(n) is negative, CD(n) is indicative of an excess toner concentration. Consequently, additional toner will not be added to the developer material. However, in order to track the excess toner concentration, excess concentration value MD(n) is set equal to the magnitude of CD(n), neglecting the sign of CD(n), at step 224. Subsequently, at step 226, CD(n) is reset to zero as described previously to prevent addition of toner to the developer material. If CD(n) was determined to be a positive value, as the result of decision step 222, the excess concentration value MD(n) is reset to zero at step 228 to prevent further propagation of the excess toner error.

Once all the current values are established, step 230 saves them for use during the following control period. More specifically, step 230 stores the values as follows:

$$CD(n-1) \leftarrow CD(n),$$

$$E(n-1) \leftarrow E(n),$$

and $$MD(n-1) \leftarrow MD(n).$$

In addition, this step may include the ability to limit the values of both CD(n) and/or MD(n) in order to limit the propagation of large amounts of error that occur due to system limitations. For example, if CD(n) were unbounded, the error could accumulate over many periods and when the system was able to respond accordingly, an excessive amount of toner may be added to the developer material.

In the succeeding steps, the duty cycle of the AC motor is determined in accordance with the aforementioned control law. Generally, the control law is implemented as a software programmed CASE or SELECT statement but for clarity it has been illustrated in FIG. 4B as a series of decision steps. Step 232 first tests CD(n) to determine if it is less than the minimum level required to initiate the dispensing of toner. Decision step 232 illustrates the comparison of CD(n) against a value (MIN−100). The value (MIN−100) is indicative of a threshold level below which no toner is to be added to the system (i.e. the system is within reasonable error of the desired toner concentration). If CD(n) is below (MIN−100), the duty cycle is set at 0 at step 234 and no toner will be dispensed from container 112 of FIG. 2 to developer sump 114.

Step 236 tests CD(n) to determine if it is greater than the maximum dispense level (MAX), where MAX is a normalized representation of the 0.8 limit imposed on the control law. If CD(n) meets or exceeds MAX, the duty cycle of the AC motor is set to a predetermined HIGH duty cycle at step 238. Generally, the duty cycle associated with HIGH is determined at the time the machine is installed in order to compensate for the differences in performance of AC motor 118 when utilizing 50 or 60 Hertz AC power. If CD(n) was less than MAX, testing continues at step 240 where CD(n) is compared to MIN, where MIN is the normalized representation of the 0.2 limit of the control law. If CD(n) is less than MIN, it falls into the lower fixed duty cycle range and the duty cycle is set to NORMAL at step 244, the NORMAL duty cycle being determined in a similar manner as the HIGH duty cycle. Otherwise, the duty cycle is established in proportion to the value of CD(n) in step 242. Specifically, the duty cycle is determined as a function of the value of CD(n).

Subsequent to determining a non-zero duty cycle for the AC dispense motor 118, the motor is energized at step 246 via a signal passed from controller 124 to dispense motor control 126, both of FIG. 2. Wait step 248 delays further processing until the duty cycle time has been reached, at which time processing continues with step 250. Step 250 stops AC motor 118, also via dispense motor control 126, thereby preventing further toner addition from occurring. The control process is completed at step 250 and the control process is exited until a subsequent control cycle is initiated once again at step 210.

In recapitulation, the apparatus of the present invention includes an apparatus for controlling the concentration of toner within a developer material of carrier and toner having a control means for generating a toner addition signal indicative of the amount of toner to be added to the developer material. The control means including the ability to measure the concentration of toner within the developer material during at least a first period and a second period subsequent to the first period. The control means also determining a first concentration error value as a function of the deviation between the toner concentration measured during the first period and a first reference toner concentration and a second concentration error value as a function of the deviation between the toner concentration measured during the second period and a second reference toner concentration. Subsequently, the control means generates the toner addition signal as a function of the first and second concentration error values. The apparatus also includes means, responsive to the toner addition signal, for regulating the addition of toner to said developer material.

It is, therefore, evident that there has been provided, in accordance with the present invention, an apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for controlling the concentration of toner within a developer material of carrier and toner, comprising:

control means for generating a toner addition signal indicative of the amount of toner to be added to the developer material, said control means including the ability to measure the concentration of toner within the developer material during at least a first period and a second period subsequent to the first period, said control means determining a first concentration error value as a function of the deviation between the toner concentration measured during the first period and a first reference toner concentration and a second concentration error value as a function of the deviation between the toner concentration measured during the second period and a second reference toner concentration, said control means further determining the amount of toner added to the developer material during an interval that begins when the toner concentration is measured during the first period and ends when the toner concentration is measured during the second period, said control means generating the toner addition signal as a function of the first and second concentration error values in conjunction with the amount of toner added to the developer material during the interval; and means, responsive to the toner addition signal, for regulating the amount of toner added to said developer material.

2. The apparatus of claim 1, wherein the first reference toner concentration is equal to the second reference toner concentration.

3. The apparatus of claim 1, wherein said regulating means comprises;

means for quantizing the toner addition signal into a plurality of toner dispense levels; and means, responsive to the toner dispense level, for selecting a duty cycle during which toner will be added to the developer material.

4. The apparatus of claim 3, wherein the selected duty cycle is a fixed duty cycle.

5. The apparatus of claim 3, wherein the selected duty cycle is a variable duty cycle having a length directly proportional to the magnitude of the toner addition signal.

6. An apparatus for controlling the concentration of toner within a developer material of carrier and toner, comprising:

control means for generating a toner addition signal indicative of the amount of toner to be added to the developer material, said control means including the ability to measure the concentration of toner within the developer material during at least a first period and a second period subsequent to the first period, said control means determining a first concentration error value as a function of the deviation between the toner concentration measured during the first period and a first reference toner concentration and a second concentration error value as a function of the deviation between the toner concentration measured during the second period and a second reference toner concentration, said control means further determining an excess toner value during the first period as a function of the difference between the toner concentration measured during the first period and the first reference toner concentration, whereby the excess toner value is indicative of a measured toner concentration which is greater than a reference toner concentration, said control means also determining the amount of toner added to the developer material during an interval that begins when the toner concentration is measured during the first period and ends when the toner concentration is measured during the second period, said control means generating the toner addition signal as a function of the first and second concentration error values in conjunction with the amount of toner added to the developer material during the interval and the magnitude of the excess toner value; and means, responsive to the toner addition signal, for regulating the addition of toner to said developer material.

7. The apparatus of claim 6, wherein said control means includes means for summing the excess toner values from at least the first period and second period to determine an accumulated excess toner value, said control means generating the toner addition signal as a function of the first and second concentration error values and the magnitude of the accumulated excess toner value.

8. The apparatus of claim 7, wherein the magnitude of the toner addition signal is limited to a predetermined maximum value.

9. The apparatus of claim 7, wherein the magnitude of the accumulated excess toner value is limited to a predetermined maximum value.

10. An apparatus for controlling the concentration of toner within a developer material of carrier and toner, comprising:

means for periodically measuring the concentration of toner within the developer material;

means, operative at a first time, for determining a first concentration error indicative of the deviation of the measured toner concentration from a target toner concentration;

means, operative at a second time subsequent to the first time, for determining a second concentration error indicative of the deviation of the measured toner concentration from the target toner concentration;

means for determining the amount of toner that was added to the development material between the first time and the second time; and means, responsive to the first concentration error, the second concentration error and the amount of toner added between the first and second times, for controlling the amount of toner added to the developer material.

11. An apparatus according to claim 10, wherein said first concentration determining means comprises:

means, operative at the first time, for subtracting the measured toner concentration from the target toner concentration, said subtracting means producing the first concentration error; and storage means for storing the first error value for use at a subsequent time.

12. An apparatus according to claim 11, wherein said second concentration determining means comprises means, operative at the second time, for subtracting the measured toner concentration from the target toner concentration, said subtracting means producing the second concentration error.

13. An apparatus according to claim 12, wherein said toner concentration measuring means, comprises:

means for forming a latent test image on a member;

means for developing said latent test image with the developer material;

a sensor for sensing the developed toner mass present within the developed test image; and means, in communication with said sensor, for integrating a signal from said sensor, said integrating means producing an indication of the concentration of toner within the developer material.

14. The apparatus of claim 13, wherein said sensor comprises an infrared densitometer positioned adjacent the member.

15. An apparatus according to claim 10, wherein said controlling means comprises:

means for calculating a weighted first error value, said value representing the product of a first weighting factor and the first concentration error;

means for calculating a weighted second error value, said value representing the product of a second weighting factor and the second concentration error;

means, responsive to the weighted first error value, the weighted second error value and the amount of toner added between the first and second times, for determining a current toner dispense level;

means for converting said current toner dispense level into a duty cycle;

means, responsive to the duty cycle, for actuating a toner feed mechanism, thereby adding a quantity of toner to the developer mixture, whereby the quantity of toner added is proportional to the length of the duty cycle.

16. The apparatus of claim 15, wherein said controlling means comprises means for limiting the magnitude of the current toner dispense level.

17. The apparatus of claim 15, wherein said controlling means comprises a feedback controller, said feedback controller being dependent upon the rate at which the toner accumulates triboelectric charge subsequent to introduction into the developer material.

18. An electrophotographic printing machine having a development subsystem arranged to supply a developer mixture, with a controlled toner concentration, for the development of a latent electrostatic image, including:

means for periodically measuring the toner concentration within the developer mixture;

means, operative at a first time, for calculating a first error value which is indicative of the deviation of the measured toner concentration from a first desired toner concentration;

means, operative at a second time subsequent to the first time, for calculating a second error value which is indicative of the deviation of the measured toner concentration from a second desired toner concentration;

means, operative between the first and second times, for determining the amount of toner that was added to the development mixture;

means, responsive to the first error value, the second error value and the amount of toner added, for generating a toner dispense level; and means, responsive to the toner dispense level, for regulating the amount of toner added to the development mixture.

19. An apparatus according to claim 8, wherein said generating means comprises:

means, operative at a plurality of times, for calculating a plurality of error values which are indicative of the deviation of the measured toner concentration from a desired toner concentration;

means, operative at the plurality of times, for accumulating the error values whenever the error value is indicative of an excess toner concentration, said accumulating means producing an accumulated error value;

means for resetting the accumulated error value to a predetermined value whenever one of the error values is indicative of an insufficient toner concentration; and means, responsive to the first error value, the second error value, the amount of toner added and the accumulated error value, for generating a toner dispense level.

20. In a subsystem arranged to supply a developer material having a controlled toner concentration, the method of controlling the toner concentration, comprising the steps of:

periodically measuring the toner concentration within the developer material;

determining a first error value at a first instant, the first error value indicating the deviation of the measured toner concentration from a first desired toner concentration;

determining a second error value at a second instant subsequent to the first instant, the second error value indicating the deviation of the measured toner concentration from a second desired toner concentration;

determining a first toner dispense level which is indicative of the amount of toner that was added to the development material between the first instant and the second instant;

generating a second toner dispense level in response to the first error value, the second error value and the first toner dispense level; and regulating the amount of toner added to the development material in proportion to the second toner dispense level.

21. The method of claim 20, wherein the step of generating a second toner dispense level includes the steps of:

calculating a weighted first error value representing the product of a first weighting factor and the first error value;

calculating a weighted second error value representing the product of a second weighting factor and the second error value; and generating the second toner dispense level in response to the weighted first error value, the weighted second error value and the first toner dispense level.

22. The method of claim 21, wherein the step of generating a second toner dispense level includes the step of limiting the magnitude of the second toner dispense level.

23. In a subsystem arranged to supply a developer material having a controlled toner concentration, the method of controlling the toner concentration, comprising the steps of:

periodically measuring the toner concentration within the developer material;

determining a first error value at a first instant, the first error value indicating the deviation of the measured toner concentration from a first desired toner concentration;

determining a second error value at a second instant, subsequent to the first instant, the second error value indicating the deviation of the measured toner concentration from a second desired toner concentration;

determining a first toner dispense level which is indicative of the amount of toner that was added to the development material between the first instant and the second instant;

calculating a weighted first error value representing the product of a first weighting factor and the first error value, calculating a weighted second error value representing the product of a second weighting factor and the second error value, accumulating the error values whenever the values are indicative of a measured toner concentration greater than the corresponding desired toner concentration to determine an accumulated error value;

resetting the accumulated error value to a predetermined value whenever the measured toner concentration is less than the desired toner concentration;

generating a second toner dispense level in response to the weighted first error value, the weighted second error value, the first toner dispense level and the accumulated error value; and regulating the addition of toner to the development material in proportion to the second toner dispense level.

* * * * *

UNITED STATES PATENT AND TRADEMARK OFFICE

CERTIFICATE OF CORRECTION

PATENT NO : 5,081,491

DATED : January 14, 1992

INVENTOR(S) : Richard A. Lux et al.

It is certified that error appears in the above--identified patent and that said Letters Patent is hereby corrected as shown below:

Page 1, under the sub-heading of Inventors, at line 2, after "N.Y." add --and Prasad Padmanabhan of Amherst, Mass.--

Claim 19, line 1, cancel the reference numeral "8", and insert the reference numeral --18--.

Signed and Sealed this

Twenty-seventh Day of April, 1993

*Attest:*

MICHAEL K. KIRK

*Attesting Officer*

*Acting Commissioner of Patents and Trademarks*